US006331124B1

(12) United States Patent
Miyazaki et al.

(10) Patent No.: US 6,331,124 B1
(45) Date of Patent: Dec. 18, 2001

(54) WATERPROOF CONNECTOR

(75) Inventors: Sho Miyazaki; Tetsuo Ichioka, both of Nagoya (JP)

(73) Assignees: Autonetworks Technologies Ltd., Nagoya; Sumitomo Wiring Systems, Ltd., Yokkaichi; Sumitomo Electric Industries, Ltd., Osaka, all of (JP)

( * ) Notice: Subject to any disclaimer, the term of this patent is extended or adjusted under 35 U.S.C. 154(b) by 0 days.

(21) Appl. No.: 09/643,732

(22) Filed: Aug. 23, 2000

(30) Foreign Application Priority Data

Aug. 23, 1999 (JP) ..... 11-235983

(51) Int. Cl.[7] ..... H01R 13/52
(52) U.S. Cl. ..... 439/587
(58) Field of Search ..... 439/587–589, 439/274, 275

(56) References Cited

U.S. PATENT DOCUMENTS 5,573,429 * 11/1996 Miyazaki et al. ..... 439/587
5,580,264 * 12/1996 Aoyama et al. ..... 439/587
5,890,927 * 4/1999 Yashima ..... 439/587
5,934,938 * 8/1999 Clark et al. ..... 439/587
5,980,316 * 11/1999 Shinchi ..... 439/587

FOREIGN PATENT DOCUMENTS 0 549 269 A1 6/1993 (EP) .
0 696 827 A2 2/1996 (EP) .
60-46672 3/1985 (JP) .
9-245872 9/1997 (JP) .
WO 96/13880 5/1996 (WO) .

* cited by examiner

*Primary Examiner*—Gary Paumen
(74) *Attorney, Agent, or Firm*—Oliff & Berridge, PLC

(57) ABSTRACT

A retainer 20 comprises a pair of half members 22U and 22L connected to each other by a hinge 21. When the retainer 20 is fitted to a housing 10 in a state where the half members 22U and 22L are combined, the retainer 20 retains rubber caps 16 from the rear so as to restrict the disengagement of the rubber caps 16. Restricting portions 24U, 25U, 24L and 25L are formed on abutment surfaces 23U*a*, 23U*b*, 23U*c*, 23L*a*, 23L*b* and 23L*c* of the half members 22U and 22L, respectively. When the half members 22U and 22L are combined, the restricting portions 24U, 25U, 24L and 25L are retained by the restricting portions on the mating half member, so that the relative displacement of the pair of half members 22U and 22L in directions along abutment surfaces 23U*a*, 23U*b*, 23U*c*, 23L*a*, 23L*b* and 23L*c* can be restricted.

4 Claims, 5 Drawing Sheets

WATERPROOF CONNECTOR

BACKGROUND OF THE INVENTION

1. Field of the Invention

The present invention relates to a waterproof connector.

2. Description of the Related Art

JP-A-60-46672 discloses a waterproof connector having a structure in which a plurality of cavities are formed in parallel inside a housing, and terminal metal fittings are inserted into the respective cavities from the rear, and rubber caps having an electric wire inserted therethrough are individually fitted to respective rear-end openings of the cavities, and moreover a retainer for collectively preventing a plurality of rubber caps from coming off is fitted to the housing.

The retainer includes a pair of half members extending in a direction in which the rubber caps are arranged. The pair of half members are connected to each other at one end of each of the pair of half members by a hinge, and are capable of undergoing opening and closing deformation between a combined state and a separated state. Concave portions for avoiding interference with the electric wires in the combined state are formed at each abutment surface of the half member. The retainer is fitted to the housing in such a manner as to retain the rubber caps from the rear of the rubber caps in the state in which the half members are combined so as to clamp the electric wires.

As for the above-described conventional retainer, since the abutment surfaces of the half members have flat shapes, when the half members are combined to each other, there is a possibility that the pair of half members undergo relative displacement while causing the abutment surfaces to slide on each other with the hinge serving as a fulcrum.

SUMMARY OF THE INVENTION

The present invention has been devised in view of the above-described circumstances, and an object of the present invention is to prevent the mutual displacement of the half members when the half members are combined.

According to a first aspect of the invention, there are provided:

a housing defining a plurality of cavities each having a terminal inserting port;

a plurality of terminal metal fittings secured to a plurality of electric wires respectively and inserted into the plurality of cavities respectively;

a plurality of rubber caps through which the plurality of electric wires are watertightly inserted respectively, the plurality of rubber caps fitted in the terminal inserting ports of the cavities respectively; and a retainer fitted to the housing for restricting the disengagement of the rubber caps, the retainer comprises a pair of a first and second half members connected to each other by a hinge to be removable from each other, wherein each of the first and second half members has a plurality of concave portions on an abutment surface of the half members for avoiding interference with the electric wires;

the retainer retains the rubber caps in such manner that the retainer is fitted to the housing in a state in which the first and second half members are combined, to restrict the disengagement of the rubber caps; and each of the first and second half members has a restricting portion, and the restricting portion of the first half member is retained with the restricting portion of the second half member to restrict relative displacement of the first and second half members in a direction along with the abutment surfaces of the first and second half members.

According to a second aspect of the invention, in the first aspect of the invention, the first and second half members are connected to each other by the hinge at one end portion of each of the first and second half members in the longitudinal direction of the first and second half members;

the restricting portion of each of the first and second half members comprising at least two restricting portions positioned close to the hinge and far from the hinge;

the restricting portions of the first half member are abutable against the restricting portions of the second half member in an offsetting direction with the hinge serving as a fulcrum, and directions in which the restricting portions of the first half member abut against the restricting portions of the second half member are mutually opposite between the restricting portion close to the hinge and the restricting portion far from the hinge.

According to a third aspect of the present invention, in the invention of the first aspect and the second aspect, the restricting portions are formed on the abutment surface of the half member.

According to the first aspect of the present invention, in a state where the first half member and the second half member are combined, the restricting portion of the first half member is retained by the second half member, whereby the offset in the directions along the abutment surfaces of the first and second half member is prevented.

According to the second aspect of the present invention, in the structure where the first and second half member are connected to each other by the hinge at one end portions of each of the first and second half member in the longitudinal direction, it is necessary to restrict the offset in two directions with the hinge serving as a fulcrum. However, since the structure of the restricting portion is such that the restricting portion of the first half member abuts against the second half member only in one direction to restrict the offset, the shape of each restricting portion is simplified as compared with the structure of the restricting portion to restrict the offset in two directions by one restricting portion.

According to the third aspects of the present invention, since the restricting portions are formed on the abutment surface of the first and second half member, the compact size and the simplification of the shape of the half members can be realized as compared with a case where the restricting portions are formed on the outer surface of the half member.

DETAILED DESCRIPTION OF THE PREFERRED EMBODIMENTS

Figure 1:
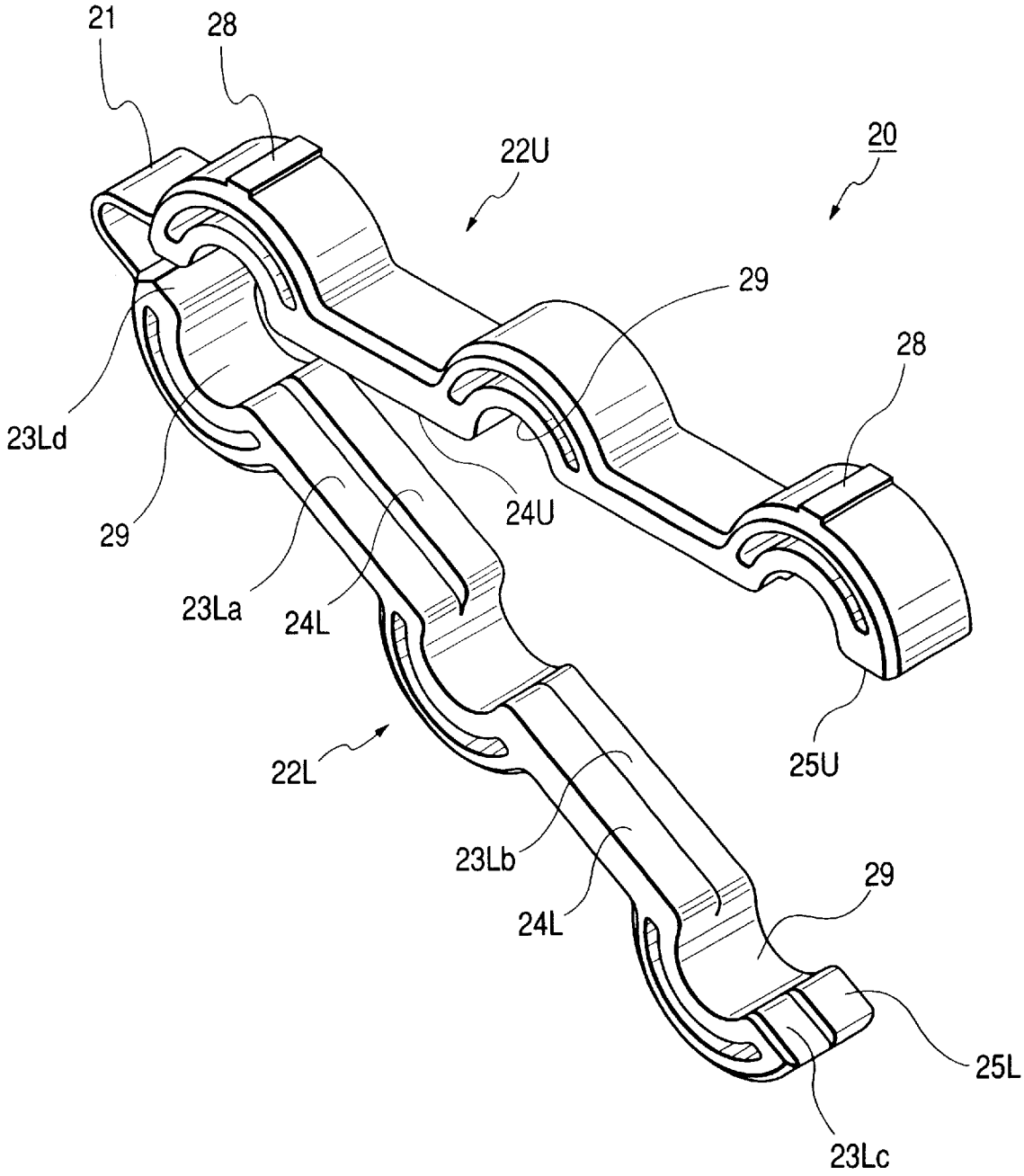
FIG. 1 shows squint view of a retainer in open state in accordance with a first embodiment.
Figure 2:
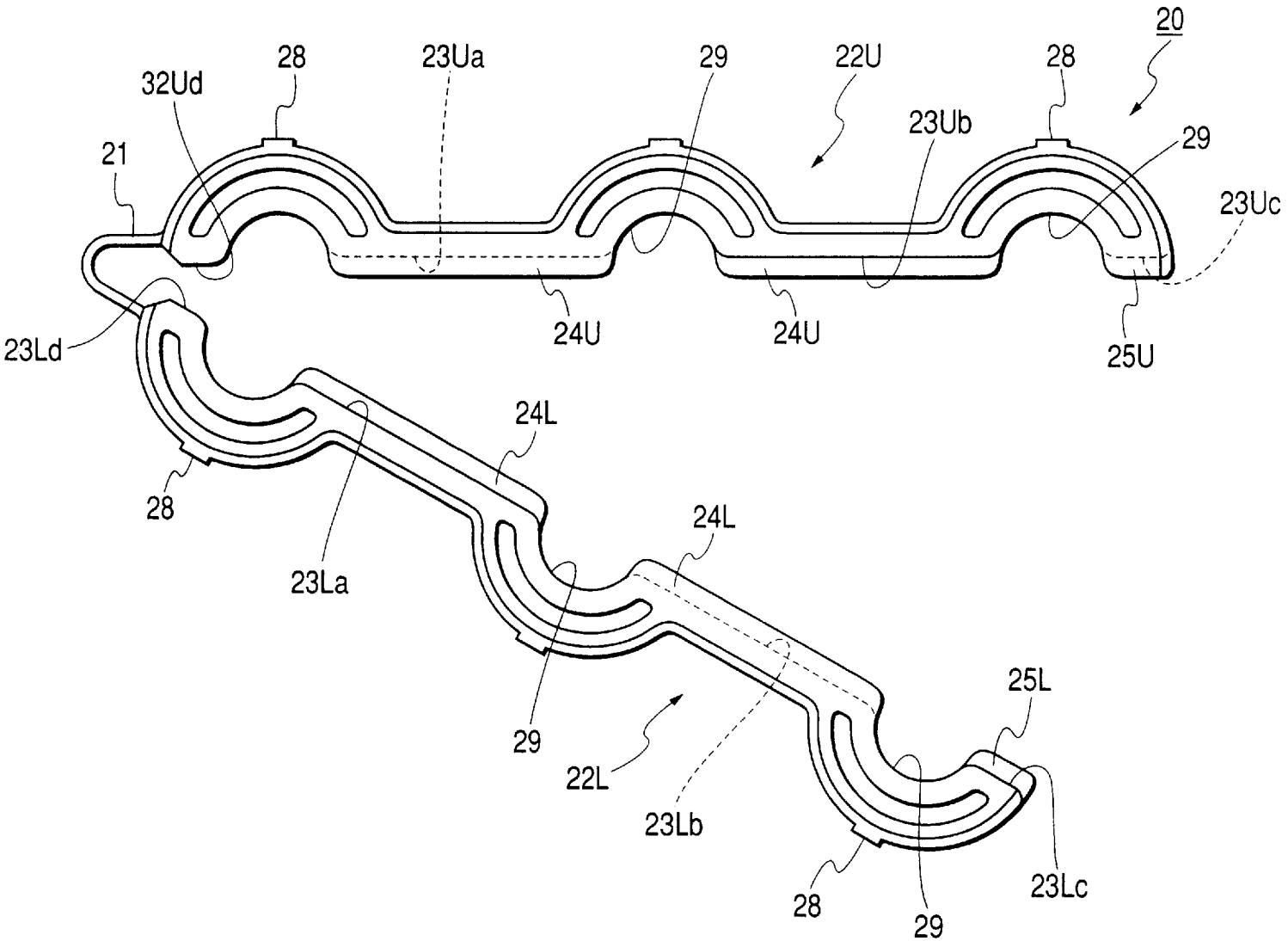
FIG. 2 shows a front view of the retainer in open state.
Figure 3:
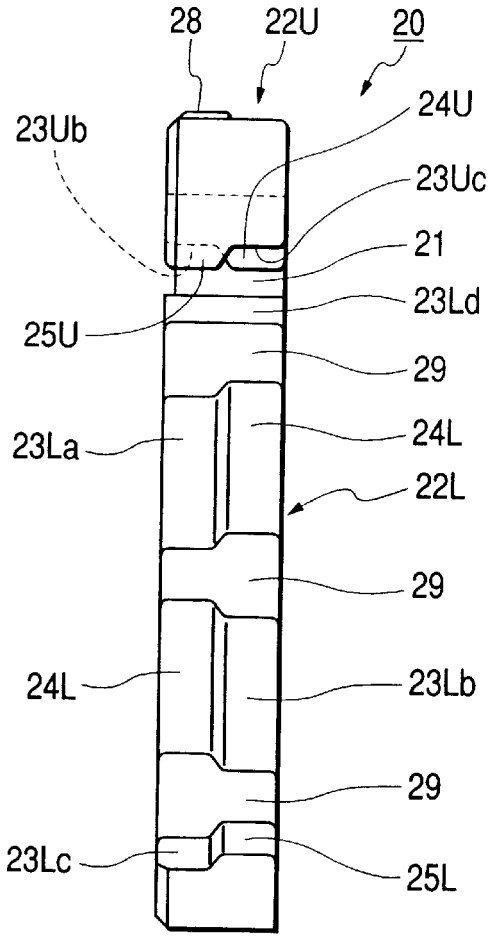
FIG. 3 shows a side view of the retainer in open state.
Figure 4:
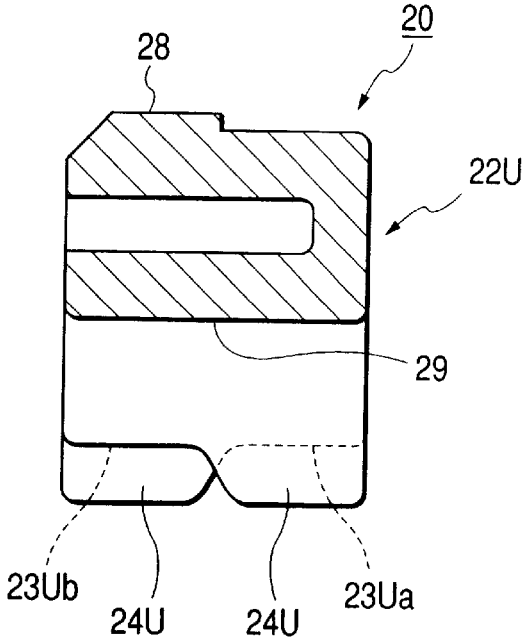
FIG. 4 shows a cross-sectional view of one half member.
Figure 5:
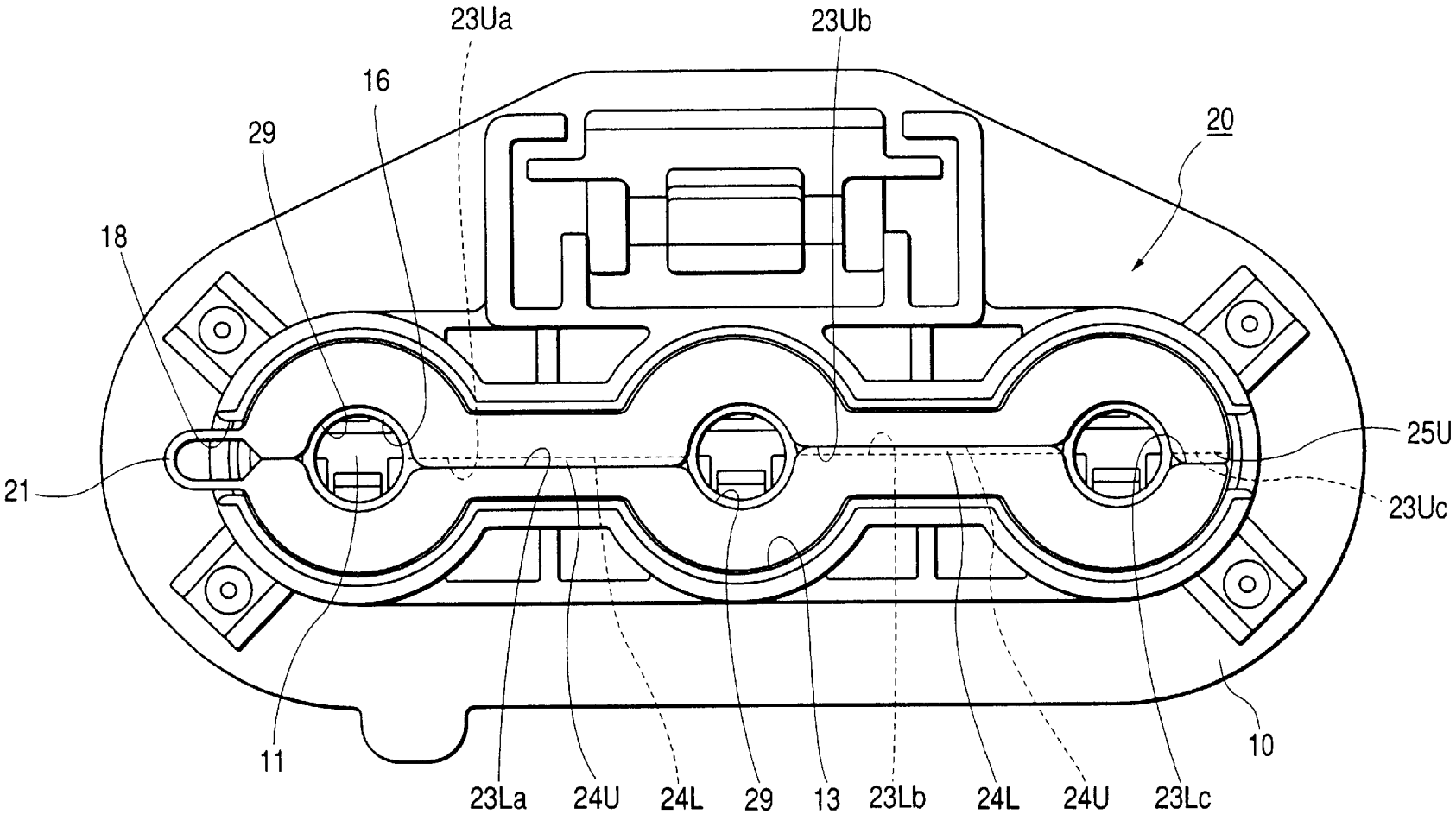
FIG. 5 shows a rear view illustrating a state in which the retainer is fitted to a housing.
Figure 6:
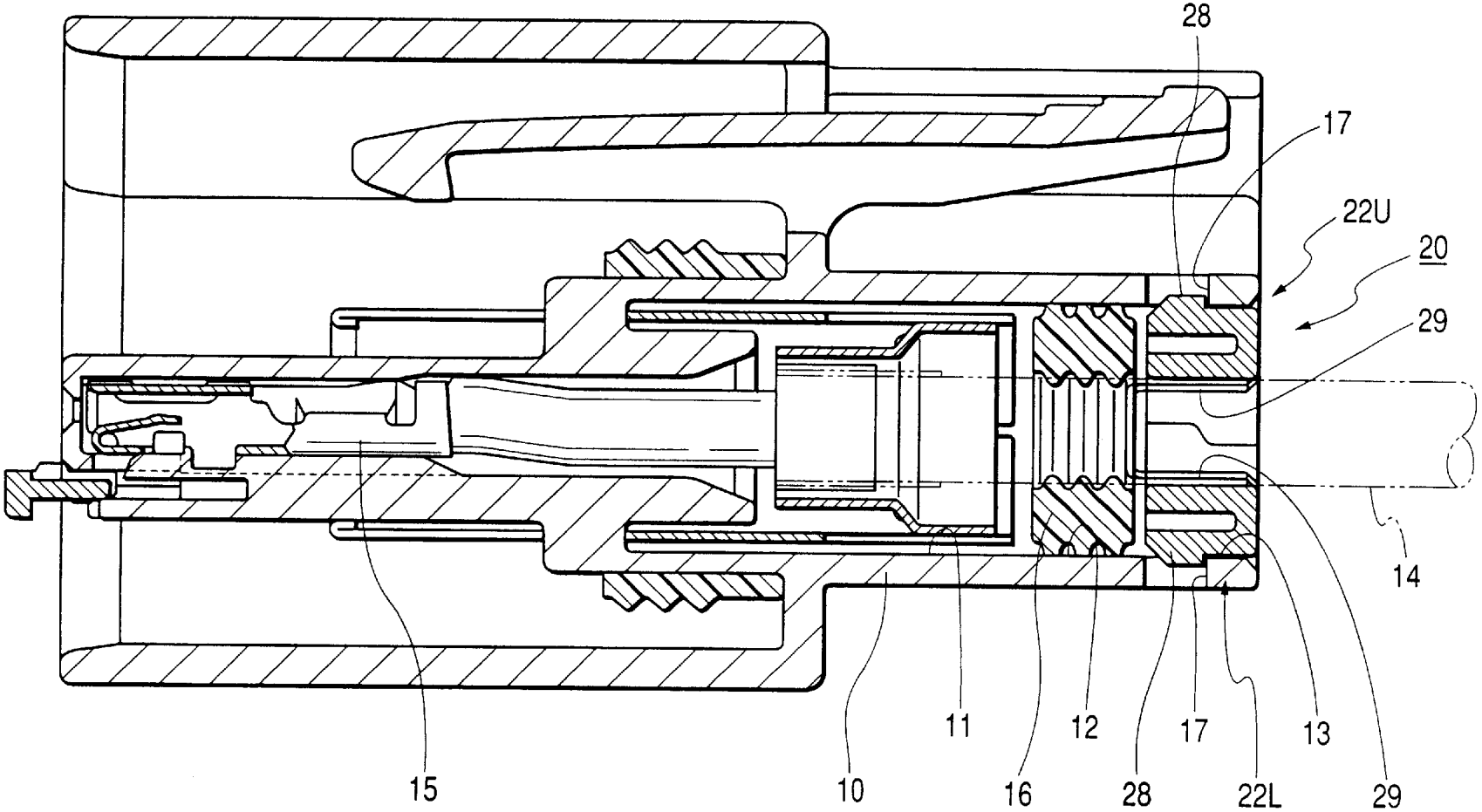
FIG. 6 shows a cross-sectional view illustrating a state in which the retainer is fitted to a housing.

Referring from FIG. 1 to FIG. 6, a description will be given of a first embodiment of the present invention.

The connector in the first embodiment comprises a synthetic resin-made housing 10, a plurality of terminal metal fittings 15, a plurality of rubber caps 16, and a retainer 20.

A plurality of cavities 11 are formed inside the housing 10 arranged in a transversely juxtaposed manner. Rear ends (right-hand end portions of the cavities in FIG. 6) of each of the cavities 11 are open as a plurality of terminal inserting ports 12, respectively. The space in the rear of each terminal inserting port 12 is as a single retainer attaching space 13 communicated to the plurality of the terminal inserting ports 12 and to a rear-end surface of the housing 10. Each of terminal metal fittings 15 secured to electric wires 14 are inserted into each of the cavities 11 from the rear of each of the cavities 11, and rubber caps 16 individually fitted over each of electric wires 14 watertightly are fitted into the terminal inserting ports 12 watertightly. Further, the retainer 20 is fitted in the retainer attaching space 13. The retainer 20 retains the plurality of rubber caps 16 from the rear side of the rubber caps 16, whereby the rubber caps 16 are restricted from moving to the rearward direction or disengaging from the housing 10.

The retainer 20 is made of a synthetic resin and comprises a hinge 21 formed from a U-shaped thin plate and a pair of half members 22U and 22L connected to each other by the hinge 21 to be removable from each other. The hinge 21 and the half members 22U and 22L are formed as a unit. The half members 22U and 22L on the whole are formed in an long and slender shape along the direction in which the rubber caps 16 are arranged, and right end portions of the half members 22U and 22L are connected to each other by the hinge 21. Arc-shaped concave portions 29 for avoiding interference with the electric wires 14 are formed in the half members 22U and 22L. The pair of half members 22U and 22L are combined such that abutment surfaces 23U*a*, 23U*b*, and 23U*c* abut against abutment surfaces 23L*a*, 23L*b*, and 23L*c*, respectively, so as to allow the electric wires 14 to be fitted to the concave portions 29. In the combined state, the pair of half members 22U and 22L is fitted in the retainer attaching space 13. Front surfaces of the half members 22U and 22L are made to abut against rear end surfaces of the rubber caps 16, whereby the fitted retainer 20 prevents the rubber caps 16 from coming off. Further, projections 28 each formed on an outer the surface of arc shape corresponding to the concave portions 29 in the half members 22U and 22L are fitted to retaining holes 17 in an inner surface of the retainer attaching space 13, whereby the retainers 20 fitted in the retainer attaching space 13 is restricted from disengaging from the housing 10. Moreover, the hinge 21 is fitted in a slot 18 formed at one end portion of the retainer attaching space 13 in a direction in which the cavities are arranged, and is partially projected laterally outside the housing 10.

In the first embodiment of the present invention, a means is provided for restricting the half members 22U and 22L from undergoing relative displacement along the abutment surfaces 23U*a*, 23U*b*, 23U*c*, 23L*a*, 23L*b*, and 23L*c* such as a pair of scissors by serving the hinge 21 as a fulcrum in the state in which the half members 22U and 22L are combined. A detailed description thereof will be given as follows.

In the first embodiment of the present invention, the concave portions 29 for avoiding interference with the electric wires 14 are provided at three positions in each of the half members 22U and 22L. Four areas each located between the central concave portion 29 and the concave portions 29 at each end of the half members are called the wide abutment surfaces 23U*a*, 23U*b*, 23L*a* and 23L*b*, respectively, and two end portions located on the outer side of the concave portion 29 at the end portion opposite to the hinge 21 are called the narrow abutment surfaces 23U*c* and 23L*c*. Rib-shaped restricting portions 24L having a substantially rectangular cross section and extending in the longitudinal direction of the lower half member 22L are formed on the two wide abutment surfaces 23L*a* and 23L*b* of the lower half member 22L shown in FIG. 1 (a perspective view, taken from a diagonally upper front direction, of the retainer 20) and in FIG. 2 (a front elevational view of the retainer 20), respectively. The restricting portion 24L on the wide abutment surface 23L*a* close to the hinge 21 is formed along the rear edge of the wide abutment surface 23L*a*, and the restricting portion 24L on the wide abutment surface 23L*b* away from the hinge 21 is formed along the front edge of the abutment surface 23L*b*. Moreover, a restricting portion 25L is also formed projectively on the narrow abutment surface 23L*c* of the lower half member 22L so as to extend along rear edge of the narrow abutment surface 23L*c*. In other words, the restricting portions 24L, 24L and 25L are formed on the three abutment surfaces 23L*a*, 23L*b* and 23L*c* of the lower half member 22L in an alternately arranged manner, respectively.

On the other hand, rib-shaped restricting portions 24U having a substantially rectangular cross section and extending in the longitudinal direction of the upper half members 22U are also formed on the two wide abutment surfaces 23U*a* and 23U*b* of the upper half member 22U, respectively. Contrary to the restricting portions 24L of the lower half member 22L, a restricting portion 24U of the upper half member 22U at the wide abutment surface 23U*a* close to the hinge 21 is formed along front edge of the upper half member 22U, and a restricting portion 24U at the wide abutment surface 23U*b* away from the hinge 21 is formed along rear edge of the upper half member 22U. Moreover, a restricting portion 25U is also formed projectingly on the narrow abutment surface 23Uc of the upper half member 22U so as to extend along front edge of the upper half member 22U. In other words, the restricting portions 24U, 24U and 25U are also formed on the three abutment surfaces 23U*a*, 23U*b* and 23U*c* of the upper half member 22U in an alternately arranged manner but in the front-and-rear reversed arrangement as compared to the restricting portions 24L and 25L of the lower half member 22L, respectively.

Incidentally, the restricting portions are not formed on abutment surfaces 23U*d* and 23L*d* close to the hinge 21, and the abutment surfaces 23U*d* and 23L*d* are formed flat all over for abutment with the mating abutment surfaces 23L*d* and 23U*d*.

The aforementioned restricting portions 24L, 24U, 25L and 25U occupy half areas of the abutment surfaces 23U*a*, 23U*b*, 23U*c*, 23L*a*, 23L*b* and 23L*c* in the back-and-forth widthwise direction of the half member 22, respectively. Accordingly, when the upper and lower half members 22U and 22L are combined to each other, the restricting portions 24U and 25U of the upper half member 22U and the restricting portions 24L and 25L of the lower half member 22L abut against each other alternately in the back-and-forth direction of the half member 22. In other words, the lower half member 22L abuts against the restricting portions 24U and 25U of the upper half member 22U such that: the restricting portion 24L on the wide abutment surface 23L*a* closest to the hinge 21 abuts from the rear of the upper half member 22U; the restricting portion 24L on the wide abutment surface 23L*b* abuts from the front of the upper half member 22U; and the restricting portion 25L on the narrow abutment surface 23L*c* abuts from the rear of the upper half member 22U. Consequently, the upper and lower half members 22U and 22L are restricted from the relative displacement in the back-and-forth direction of the upper and lower half member 22U and 22L, i.e., from being offset back and forth like a pair of scissors with the hinge 21 serving as a fulcrum.

As described above, in accordance with the first embodiment of the present invention, when the half members 22U and 22L are combined, each of the restricting portions 24U and 25U, or 24L and 25L, are retained by each of the restricting portions 24L and 25L, or 24U and 25U, of the mating half member 22L or 22U, whereby it is possible to prevent the offset between the half members 22U and 22L in directions along the abutment surfaces 23U*a*, 23U*b* and 23U*c* and the abutment surfaces 23L*a*, 23L*b* and 23L*c* (the relative displacement like a pair of scissors with the hinge 21 serving as a fulcrum).

Further, since the pair of half members 22U and 22L are connected to each other at one end portions of the pair of the half members 22U and 22L by the hinge 21, it is necessary to restrict the offset of the half members 22U and 22L in two directions, i.e., back and forth directions with the hinge 21 serving as a fulcrum. However, since the structure provided is such that each of the restricting portions 24L, 24U, 25L and 25U abuts against the mating half member 22U or 22L to restrict the offset of the half member 22U and 22L only in one direction, the shape of each restricting portion is simplified as compared with the structure in which the offset of the half member 22U and 22L in two directions, i.e., back and forth directions, is restricted by one restricting portion.

Further, since the restricting portions 24U and 25U or 24L and 25L are formed within the abutment surfaces 23U*a*, 23U*b* and 23U*c* or 23L*a*, 23L*b* and 23L*c* (the surfaces which are hidden from the outside in the combined state) of the half member 22T*j* or 22L, the compact size and the simplification of the shape of the half members 22U and 22L can be realized as compared with a case where the restricting portions are formed in so as to project from the outer surfaces, e.g., the front or rear surfaces, of the half members 22U and 22L.

The present invention is not limited to the above-described embodiment and the drawings, and following embodiments are also included in the scope of the present invention. Furthermore, in addition following, various modifications are possible without departing from the scope of the invention.

(1) Although in the above-described embodiment the restricting portions are formed with concave and convex cross sections in a stepped manner, the cross-sectional shape of the restricting portion may be formed such as triangular, semicircular, trapezoidal or other similar shape in accordance with the present invention.

(2) Although in the above-described embodiment a description has been given of the case in which the direction to prevent the offset of the half members by the restricting portions is almost along with the axial direction of the electric wire, it is possible to provide restricting portions for preventing the offset of the half members in a direction crossing the axial direction of the electric wire in accordance with the present invention.

(3) Although in the above-described embodiment a description has been given of the case in which the present invention is applied to a connector in which the number of poles is three, the invention is also applicable to connectors whose number of poles is 2, 4 or more.

(4) Although in the above-described embodiment the restricting portions are formed in the shape of ribs extending along the longitudinal direction of the half member, the restricting portions may be formed as projections or holes in accordance with the present invention.

(5) Although in the above-described embodiment the restricting portions are formed on both half members, and the restricting portions are retained by each other, in accordance with the present invention, a structure may be provided such that the restricting portions formed on both half members are retained by portions other than the restricting portions of the mating half member or the restricting portions formed on either one of the half members are retained by the mating half member.

(6) Although in the above-described embodiment the restricting portions are formed on the abutment surfaces of the half members, the restricting portions may be formed at positions other than the abutment surfaces (e.g., front-end faces and/or rear-end faces of the half members) in accordance with the present invention.

(7) Although in the above-described embodiment the hinge is provided so as to project outwardly from the end portions of the half members in the longitudinal direction thereof, the hinge may be provided so as to fasten the rear end faces of the half members each other in accordance with the present invention. In this way, the size in a widthwise direction (in the longitudinal direction of the half members) can be reduced.

(8) Although in the above-described embodiment the restricting portions are arranged along the front edges or rear edges of the half members, in accordance with the present invention the restricting portions of one half member may be formed in the shape of ribs projecting from the center, as viewed in the back-and-forth widthwise direction, on abutment surfaces of the half members, while the restricting portions of the other half member may be formed in the shape of grooves in the center, as viewed in the back-and-forth widthwise direction, on abutment surfaces of half members.

What is claimed is:

1. A waterproof connector comprising:

a housing defining a plurality of cavities each having a terminal inserting port;

a plurality of terminal metal fittings secured to a plurality of electric wires respectively and inserted into the plurality of cavities respectively;

a plurality of rubber caps through which the plurality of electric wires are watertightly inserted respectively, the plurality of rubber caps fitted in the terminal inserting ports of the cavities respectively; and a retainer fitted to the housing for restricting the disengagement of the rubber caps, the retainer comprises a pair of a first and second half members connected to each other by a hinge to be removable from each other, wherein each of the first and second half members has a plurality of concave portions on an abutment surface of the half members for avoiding interference with the electric wires;

the retainer retains the rubber caps in such manner that the retainer is fitted to the housing in a state in which the first and second half members are combined, to restrict the disengagement of the rubber caps; and each of the first and second half members has a restricting portion, and the restricting portion of the first half member is retained in the restricting portion of the second half member to restrict relative displacement of the first and second half members in a direction along with the abutment surfaces of the first and second half members.

2. The waterproof connector according to claim 1 wherein the first and second half members are connected to each other by the hinge at one end portion of each of the first and second half members in the longitudinal direction of the first and second half members;

the restricting portion of each of the first and second half members comprising at least two restricting portions positioned close to the hinge and far from the hinge respectively;

the restricting portions of the first half member are abuttable against the restricting portions of the second half member with the hinge serving as a fulcrum, and directions in which the restricting portions of the first half member abut against the restricting portions of the second half member are mutually opposite between the restricting portions close to the hinge and the restricting portions far from the hinge.

3. The waterproof connector according to claim 1, wherein the restricting portions are formed on the abutment surface of each of the first and second half members.

4. The waterproof connector according to claim 2, wherein the restricting portions are formed on the abutment surface of each of the first and second half members.

* * * * *